United States Patent [19]

Jeter

[11] 4,120,097

[45] Oct. 17, 1978

[54] PULSE TRANSMITTER

[76] Inventor: John Doise Jeter, 201 W. Clara, Iowa Park, Tex. 76367

[21] Appl. No.: 511,218

[22] Filed: Oct. 2, 1974

[51] Int. Cl.[2] ..... E21B 47/022

[52] U.S. Cl. ..... 33/307; 175/45

[58] Field of Search ..... 33/307, 306; 175/45

[56] References Cited

U.S. PATENT DOCUMENTS

| | | | |
|---|---|---|---|
| 3,077,233 | 2/1963 | Armstrong | 33/307 |
| 3,384,750 | 5/1968 | Owen | 33/312 |
| 3,581,404 | 6/1971 | Sanfead | 33/307 |
| 3,710,448 | 1/1973 | Kimmel et al. | 33/306 |
| 3,737,843 | 6/1973 | Peuvedic et al. | 175/45 |

*Primary Examiner*—Steven L. Stephan

[57] ABSTRACT

Apparatus is provided for use attached to a pipe string in a well drilling, service or servicing operation to create a signal in a fluid stream flowing in the pipe string and in material of the pipe string in response to indications of down hole sensors. The signal created consists of brief pulses created down hole and detectable at the earth surface as pressure changes in fluid flowing in the pipe string. Alternately, periodic bursts of higher frequency stress variations in the pipe string walls are transmitted as pulses. The repetition rate of the pulses varies over a preselected range as the down hole sensor output changes over a preselected range. The transmitter, which may be lowered and recovered through the pipe string bore, derives its power from the fluid pressure differential used to create pressure pulses. The pulse repetition rate variation dictated by a sensor output is controlled without taking energy from the sensor.

16 Claims, 10 Drawing Figures

PULSE TRANSMITTER

In operations within earth bore holes, it is often necessary to transmit information from the down hole location to the earth surface, for instance, to orient and otherwise control down hole assemblies relative to earth. The usual occasion involves the azimuthal orientation of the tool face of directional drilling services. Since surveys are normally made before the realization that the bore hole direction needs changing, the relationship between the earth coordinates and the bore hole low side is normally known. It is, then, convenient to use the bore hole low side as an intermediate reference in orienting down hole assemblies relative to the earth coordinates. Use of the earth magnetic field is, of course, traditional.

It is common practice to use orienting devices lowered into the bore of the drill string on wire lines to orient directional drilling assemblies by signals through the wire line or by photograpic means. This is time consuming and involves an undesirable amount of vulnerable instrumentation and equipment that does not serve the purpose of producing hole.

In situations where the hole is near vertical and the earth magnetic field is too distorted to be reliably used to orient down hole assemblies, gyroscope device are used. This has traditionally required the use of wire lines in the pipe bore. It is desirable to obtain gyro related information while drilling without using wire lines.

Since fluid is pumped down the bore of the pipe string in normal drilling operations to remove cuttings and to drive down hole drill bit driving motors, if such motors are in use, it is desirable to use the drilling fluid column as a communication means. My copending application Ser. No. 484,413 filed July 1, 1974 causes pressure pulses to be created in the drilling fluid stream when the down hole assembly is in a preselected orientation relative to earth. It does not create pulses when the down hole assembly is in any other orientation. It is desirable in some situations to know the orientation of the down hole assembly when it is not in a preselected orientation so that proper manipulation of the drill string may be undertaken at the earth surface in order to cause the desired changes down hole.

Customary use of down hole instruments that produce signals in the fluid flowing in the pipe string bore involves the installation of the instrument into the pipe string before the pipe string is inserted into the bore hole. To remove the down hole instrument, then, the pipe string must be removed from the bore hole. By attaching a first element of a valve to the pipe string and a second element of the valve to an instrument package that can be lowered through the pipe string, signals in the fluid stream can be produced by apparatus that can be lowered down the bore of the assembly pipe string and recovered by a wire line.

In deep holes, the problem of attenuation of a signal consisting solely of pressure pulses in the drilling fluid has not been overcome. In many cases also, higher frequency vibrations produced in the drill string wall have to compete with changing vibrations produced by a drill bit with occasional loss of signal. Since conditions in the drilling system continually change, it has been found that signals produced down hole periodically fade at the earth surface only to return in renewed strength at some later time. It is then desirable to use a pulse transmitter down hole that will produce either or both pulses as brief pressure changes in fluid in the pipe and brief bursts of higher frequency variations in the fluid pressure and in stresses in the pipe string wall.

The term pulse as used herein refers to a periodic change in pressure in fluid moving in a pipe string, to periodic change in stress in the material making up the pipe string, to a brief series of higher frequency pressure changes and to a brief series of stress variations in the material of a pipe string. Repetition rate refers to the rate of occurrence of pulses. Frequency refers to the number of pressure or stress changes per unit time that occur during the pulse existence in the case of superimposed pressure and stress variations.

Since interference with the downward movement of fluid in a pipe string causes downward impulse loading on the means to interfere or impede the downward movement of fluid, the down hole interfering device produces an increase in the fluid pressure differential between the inside and the outside of the pipe, an elongation of the pipe, and if a drill bit is consuming power while rotary drilling, it will cause a change in bit load and a consequent change in bit reaction torque. A valve means down hole, then, can by a movement toward and away from closure produce three forms of pulses that can be detected at the earth surface. A pressure pulse will be produced, an axial tension pulse will be produced in the drill pipe and a drill string rotational torque pulse will be produced.

Since damping, resilience and resonance qualities differ, the frequencies carried best by the fluid in the pipe will seldom be the same as those best carried by the drill string material. It is desirable, then, to be capable of simultaneously producing pulses used in information transmission with a high frequency oscillation of the pulse transmitting medium superimposed upon the pulse. It is further desirable to be able to transmit pulses in more than one of the three forms of pulses simultaneously.

It is further desirable to adjust the ratio of pulse total energy and the energy of the high frequency component of superimposed pulses and to select the distribution of signal energy to be used in the fluid pressure pulse, axial stress in pipe wall and torsional stress in the pipe wall.

It is an object of this invention to provide down hole apparatus that will create pressure pulses in the fluid stream in a pipe string, detectable at the earth surface, that occur with a repetition rate having a preselected relationship to the indications of a sensor associated with a down hole assembly, without a special power source to generate signals and without extracting energy from the sensor.

It is a further object of this invention to provide apparatus that can optionally utilize the power produced by a signal creating differential pressure in the down hole assembly to produce stress variations in the pipe string wall for transmission of information.

It is another object of this invention to provide a down hole apparatus attached to a pipe string that will create signal pulses in a pipe string detectable at the earth surface that occur with a range of repetition rates having a minimum rate when the down hole sensor produces a first preselected output, the rate increasing as the sensor output is changed in a preselected direction from the first preselected orientation, the rate reaching its maximum value at a second preselected sensor output, then abruptly dropping back to its minimum value as the first preselected output of the sensor again occurs, so that the first preselected sensor output is distinctively indicated.

It is another object of this invention to provide a pulse generating device that may be lowered and recovered through the bore of the pipe string to produce pressure pulses in the fluid in the pipe string and, if desired, stress pulses in the material of the pipe string.

It is another object of this invention to provide apparatus that may be lowered through the bore of a tubing string in a producing well to use the upward flowing product fluid to create pulses in the fluid and as desired in the tubing string wall to indicate at the earth surface the conditions detected by sensors down hole.

It is another object of this invention to provide apparatus to convert the indications of down hole sensors to pulses having a repetition rate responsive to the sensor being read without requiring power from the sensor.

These and other objects, advantages and features of this invention will be apparent to those skilled in the art from a consideration of this specification, including the attached drawings and appended claims.

BRIEF DESCRIPTION OF DRAWINGS

In the drawings, wherein like reference characters are used throughout to designate like parts.

DETAILED DESCRIPTION OF DRAWINGS

Figure 1A:
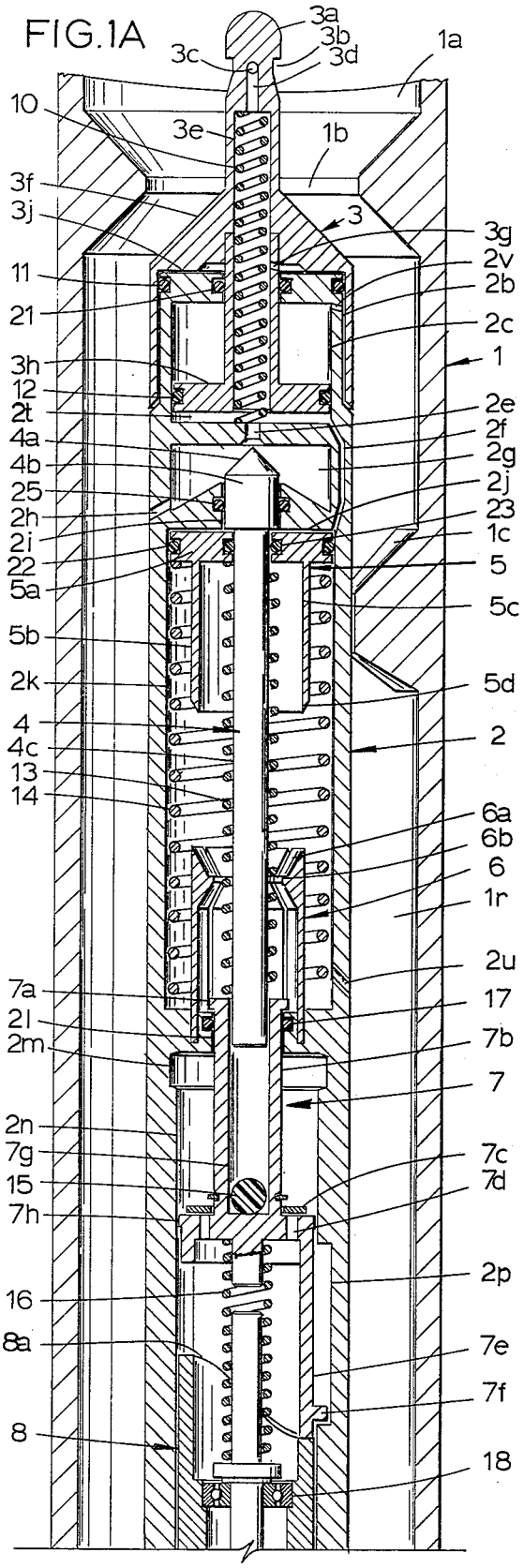
FIGS. 1A and 1B are vertical sectional views of a length of pipe string containing the preferred embodiment of the apparatus of this invention.
Figure 1B:
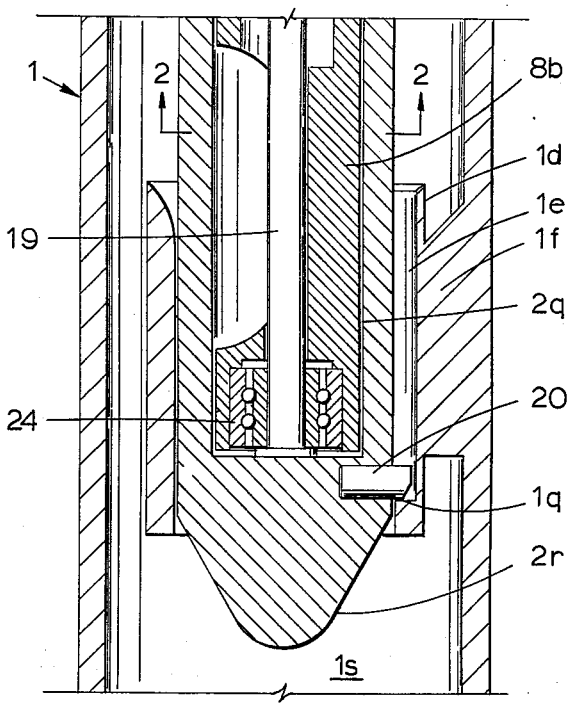
Figure 2:
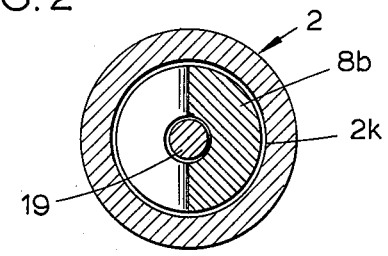
FIG. 2 is a transverse sectional view taken along line 2—2 of FIG. 1B.

FIG. 1A is the top part of the preferred embodiment of this invention, FIG. 1B being the lower end of the same apparatus. Housing 1 is part of the pipe string, the upper end being attached by threads (not shown) to the upwardly continuing pipe string, the lower end being attached by threads (not shown) to the downwardly continuing pipe string.

Fluid moving down the bore of the pipe string enters bore 1*a*, flows through valve orifice 1*b*, past valve element 3 and continues downwardly along annulus 1*r* and continues downwardly in bore 1*s* into the drilling assembly below.

First, a brief description of the principal element in terms of principal functions. A valve in the fluid steam moving in the pipe string is comprised of orifice 1*b* and valve member 3. Member 3 is movable from a first position shown, which is toward open, with low pressure drop across the valve to a second position, which is toward closure, with conical surface 3*f* nearer orifice 1*b* to produce a higher pressure drop across the valve. The pressure across the valve with a limited flow is limited because the maximum diameter of surface 3*f* is smaller than the minimum diameter of orifice 1*b*.

Means to urge the valve toward closure by processes to be described later includes control member 4. When member 4 is in a lower position shown, valve member 3 moves toward the first position. When member 4 moves upwardly, it causes valve member 3 to move to the second position.

Means to delay the movement of the valve member 3 from the first position to the second by way of delay in the movement of member 4 includes delay assembly 7. Delay means 7 is made responsive to the position of hole low side detector 8 by cam surface 8*a* which determines the starting position of delay assembly 7 by engaging tang 7*e* to stop the downward resetting movement of assembly 7. When assembly 7 is in the upper position, it is held there by retaining member 6 and in that position urges control member 4 upwardly.

Means to delay the movement of member 3 from the second to the first position comprises opening delay unit 5. Unit 5 begins moving downwardly when member 3 is in the second position and a high pressure drop exists across the valve. When unit 5 completes its downward movement compressing spring 13, tending to urge assembly 7 back to its time delay starting position, it causes retaining member 6 to release assembly 7 so that assembly 7 can move downwardly.

The detailed description will show how the preferred embodiment of the apparatus of this invention causes the valve to cycle between the first and second positions, staying in the second position long enough to produce enough signal energy in the fluid in the pipe string for the resulting pressure pulse to reach the earth surface and when in the first position to delay movement toward the section position such that the cyclic repetition rate is proportional to the rotational orientation of the down hole assembly relative to hole low side.

Valve element 3 is urged upwardly by spring 10 toward orifice 1*b* to operate as a valve to restrict the flow of fluid in the drill string to create a small pressure drop in the fluid stream to provide power to initiate action. Fluid in bore 1*a* enters port 3*c*, which is above orifice 1*b*, and flows down channel 3*d*, through spring chamber 3*e*, out port 3*g* into cylinder 3*j*. Pressure in cylinders 3*j* acts upwardly on element 3, but, since the effective piston diameter corresponds to the diameter of body projection 2*b*, which is smaller than the outside diameter of element 3, the element still remains downward and this position represents a first position for the valve comprising orifice 1*b* and surface 3*f*.

Fluid entering port 3*c* and moving downwardly in chamber 3*e* passes through orifice 2*e*, enters chamber 2*g* and flows out port 2*h*. By processes to be described later, valve element 4*b* periodically moves upwardly and cone 4*a* closes port 2*e*. Fluid moving downwardly in chamber 3*e* is then trapped in cylinder 2*t*. Pressure in cylinder 2*t* acts below piston 3*h*. The effective piston area of both piston 3*h* and cylinder 3*j* is greater than the effective piston area of conical surface 3*f* and valve element 3 is capable of moving upwardly to a second position regardless of the pressure difference across orifice 1*b*.

Delay assembly 7 is urged upwardly by spring 16. Spring 13 is such as to urge assembly 7 downwardly only when opening delay unit 5 is in a downward position. The upward movement of assembly 7 is slowed by dashpot piston 7*h* moving in fluid filled bore 2*n*. Assembly 7 is shown in a downward starting position with tang 7*e* against cam surface 8*a*. As assembly 7 nears its upper limit of travel, piston 7*h* enters the relief ring 2*m* and the dashpot effect is reduced, allowing assembly 7 to rapidly move upwardly. Resilient member 15 in bore 7*g* engages the lower extension 4*c* of control member 4 and moves it upwardly. Simultaneously, flange 7*a* moves past lock nibs 6*b* and delay assembly 7 is locked in the upward position. With upward movement of member 4, cone 4*a* is thrust into orifice 2*e*.

By processes previously described, as long as control member 4 is in the upward position, valve member 3 is urged toward the second position and a large pressure drop exists across orifice 1*b* and, hence, exists in cylinder 2*j*, being conducted by channel 2*f* from cylinder 2*t*. The higher pressure acting on piston 5*a* urges opening delay unit 5 downwardly, overcoming spring 14 and compressing spring 13. The rate of downward movement is determined by the size of channel 2*f*. As unit 5 nears the lower limit of its travel, conical surfaces 5*d* on sleeve 5*b* engages cam bevel 6*a*, urging lock nibs 6*b* radially outwardly to release flange 7*a*. With the delay assembly released from retaining member 6 and urged downwardly by compressed spring 13, assembly 7 moves downwardly. The downward resetting movement is rapid because check valve 7*c* opens, allowing fluid in bore 2*n* to by-pass piston 7*h* through holes 7*d*.

Downward movement of assembly 7 allows member 4 to move downwardly. Element 3 moves toward the first position and, as a result of the pressure drop in cylinder 2*j*, allows delay unit 5 to move upwardly.

The distance of downward travel of delay assembly 7 is limited by cam surface 8*a* on orientation detector 8. Orientation detector 8 is rotatably positioned within enclosure 2*g* being mounted on bearings 18 and 24 on central carrier 19. Detector 8 has an eccentric mass 8*b* spaced radially from the axis of rotation of detector 8. The center of gravity of mass 8*b* will lie in a plane containing its rotational centerline and the earth gravity vector. The detector 8, then, is earth oriented. Tang 7*e* is oriented with the down hole assembly by guide 7*f* in groove 2*p*. Due to the shape of cam surface 8*a*, the downward limit of travel of delay assembly 7 is dependent upon the rotational relationship of detector 8 and tang 7*e* and, hence, it is dependent upon the orientation of the down hole assembly. The total time for valve member 3 to complete one cycle of operation is proportional to the time of travel of assembly 7 from the lower limit of its travel to the upper limit of its travel; therefore, the cyclic rate of pressure signals created in the fluid stream in the pipe string is related to the orientation of the down hole assembly relative to an earth azimuthal direction.

Figure 3:
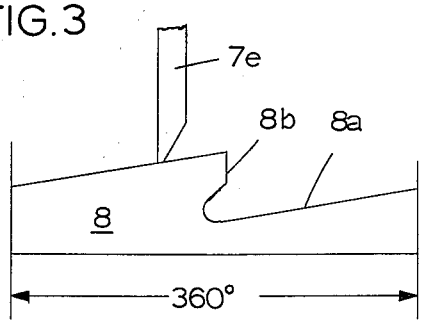
FIG. 3 is a development of a cylindrical cam and a cam follower preferred for use with the apparatus of this invention.

A preferred shape for cam surface 8*a* is shown in FIG. 3. FIG. 3 is a development of the cylindrical cam having surface 8*a* on detector 8. The abrupt drop 8*b* in joining the highest and lowest end of surface 8*a* produces an improvement in resolution for determining the orientation of the down hole assembly when tang 7*e* is in the vacinity of drop 8*b*. The orientation of body 2 within housing 1 relative to the down hole assembly tool face will normally be such that when the down hole assembly is in the preferred orientation for the activity being undertaken, tang 7*e* will be in the vacinity of drop 8*b*. Then, when the down hole assembly is rotated such that tang 7*e* moves from one side of drop 8*b* to the other a substantial change in signal frequency occurs.

In the preferred embodiment, body 2 may be lowered or dropped through the bore of the pipe string. The body will pass through orifice 1*b*. The lower end 2*r* enters the bore of a muleshoe slipper 1*d* and pin 20 will be oriented by the muleshoe 1*e* as the pin comes to rest in socket 1*q*. Muleshoe slipper 1*d* is supported within housing 1 by spiders 1*f*. The upper end of the body is stabilized radially by projections 1*c*. Orientation of the body and tang 7*e* relative to housing 1 is accomplished by inserting pin 20 in a choice of several holes (not shown) distributed about the periphery of body 2, one of which is shown occupied by pin 20. Body 2 may be lifted from the housing by lowering a wire line down the pipe string bore to place an overshot over probe 3*a* to grip groove 3*b* and lifting body 2 and its contents upwardly through the pipe string bore. This removable and replacement feature is considered an optional advantage and not in a limiting sense. The body 3 can, of course, be assembled into the housing before inserting the pipe string into the bore hole without the retrievable feature.

The feature of an instrument body containing means to move one element of a valve in relation to a cooperating orifice formed as a restriction in a pipe string bore through which the movable element may pass for the purpose of installing and removing the instrument is particularly useful in using the gyro version of the device of this invention. Gyro instruments are subject to damage and the gryo active mass requires power to maintain rotation. Recovery through the pipe string is currently needed to change power supplies and reorient gyros. The changing of sensors and renewal of transmitting machinery is also possible during bit runs. The movable element may be in the form of an expandable rubber element in the continuing cylindrical bore of a pipe string.

Seals 11 and 21 preserve the pressure integrity of cylinder 3*j*. Seal 12 assures the pressure integrity of cylinder 2*t*. Seals 22, 23 and 25 assure the pressure integrity of cylinder 2*j*. Seal 17 prevents the intrusion of fluid in opening 2*k* into the dashpot bore 2*n*. Fluid displaced from opening 2*k* by movement of piston 5*a* escapes by way of port 2*u*. Fluid displaced from bore 2*c* by upward movement of piston 3*h* flows out port 2*v*. Fluid pressure within bore 2*n* is equalized with fluid pressure outside the body by a flexible membrane (not shown).

Figure 4:
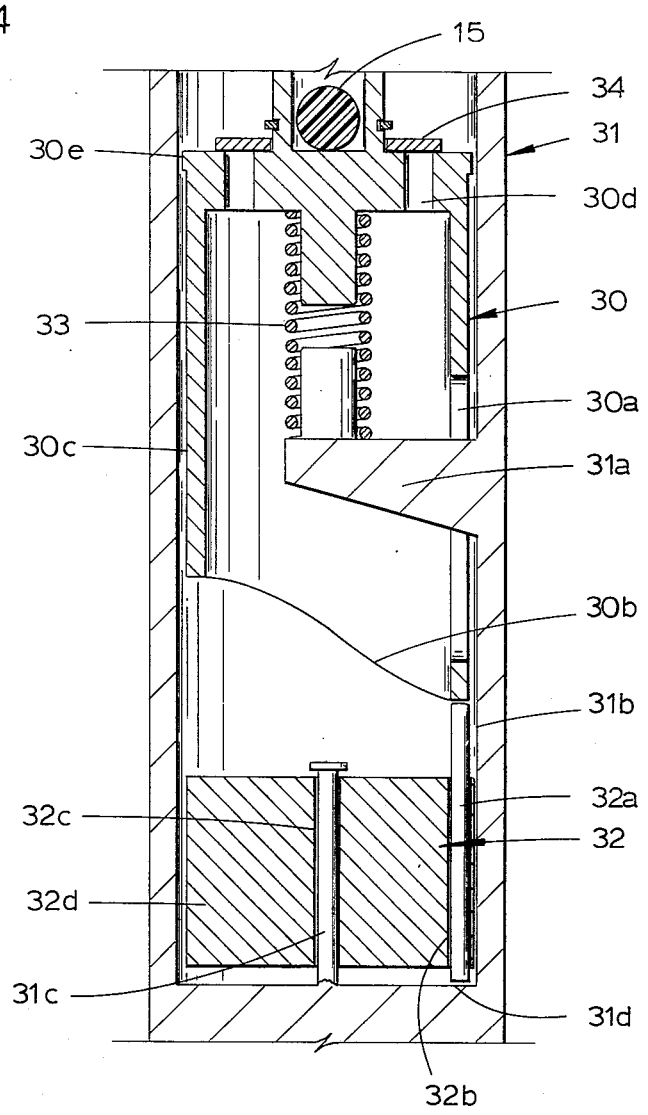
FIG. 4 is a vertical sectional view of an alternate embodiment of the device of this invention for response to a detected relative direction of a magnetic field in the earth.

FIG. 4 represents means to detect the azimuthal orientation of the down hole assembly relative to a magnetic field in the earth and to communicate the detected information to a cooperating element of the means to control the time that valve element 3 of FIG. 1 remains in the first position. The device of FIG. 4 replaces the hole low side detector 8 of FIG. 1. Delay assembly 7 of FIG. 1 is replaced by delay assembly 30 of FIG. 4. In this device the delay assembly is reset downward to a starting position each time a pressure pulse is created in the fluid flowing in the pipe string by processes described for FIG. 1. The cam surface 30*b* is held nonrotative to body 31 by bracket 31*a* extending radially through slot 30*a*. Assembly 30 can move upwardly and downwardly within bore 31*b*.

Means to detect the orientation of a magnetic field in the earth is magnetic sensor 32 having fluxgate element 32*d* situated within bore 31*b* and rotatable about central axis pin 31*c*. Ideally, element 32*d* will be of about the same specific gravity as the fluid filled bore 31*b*. Pin 32*a* is hollow and of about the same specific gravity as the fluid in bore 31*b*. Sensor 32 then can freely rotate with minimum friction to align with a magnetic field in the earth.

To relate the earth magnetic field direction with the orientation of body 31, so that the downward limit of travel of delay assembly 30 is related in turn to the body orientation relative to earth, pin 32*a* is movable about the periphery of cam surface 30*b* as element 32*d* rotates about pin 31*c*. The cam surface will preferable conform to FIG. 3 if inverted.

As assembly 30 is moved downwardly, surface 30*b* hits the top of pin 32*a* which freely moves downwardly in bore 32*b* to hit the surface 31*d*. The rotational position of pin 32*a*, when it hits surface 30*b*, determines the lower travel limit of assembly 30, hence it determines the time the assembly requires to rise to its limit of travel in dashpot bore 31*b* as slowed by piston 30*e*. Spring 33 urges assembly 30 upwardly. Holes 30*d* permit fluid to by-pass piston 30*e* to permit rapid downward movement of assembly 30. Check valve 34 closes holes 30*d* as assembly 30 moves upwardly.

Figure 5:
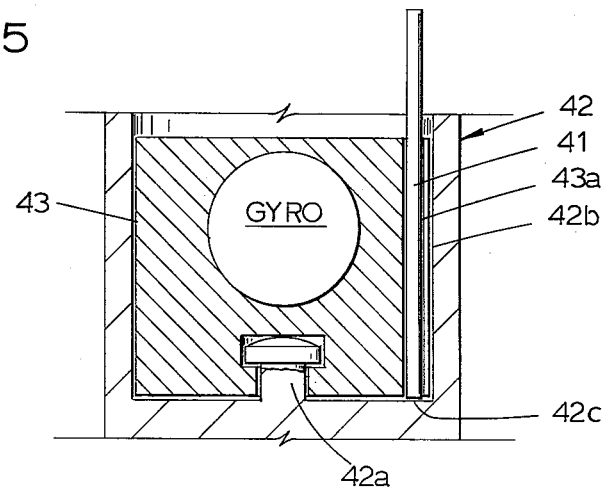
FIG. 5 is a vertical sectional view of an alternate embodiment of the device of this invention utilizing a gyroscope as a direction sensor.

The device of FIG. 5 represents a gyroscopic sensor usable with the device of this invention. The gyroscope may be assured to include whatever power supplies are required to operate it during its period of service.

Housing 42 is near the lower end of a device similar to that of FIG. 4, the north seeker unit having been replaced by gyroscope body 43 containing the gyro. The gyro remains oriented relative to earth and causes the body 43 to similarly remain earth oriented. As housing 42 rotates or oscillates relative to earth, body 43 rotates relative to the housing about journal 42*a*. Probe 41 is slidably situated in body 43 and represents a point on a radial index line extending from the axis of rotation of body 43 and intersecting the axis of probe 41. When delay assembly 30 moves downwardly for resetting as hereinbefore described, cam surface 30*b* strikes probe 41 which, in turn, slides downwardly in bore 43*a* to strike surface 42*c* of housing 42. This stops the downward travel of cam 30 of FIG. 4 without placing an impact load on the gyro. As in FIG. 4, the peripheral location of probe 41 about the axis of rotation of housing 43 determines the limit of downward travel of the pulse timing means and determines the cyclic rate at which pulses will be transmitted. The gyro index line relative to earth is customarily established at the earth surface.

Figure 6:
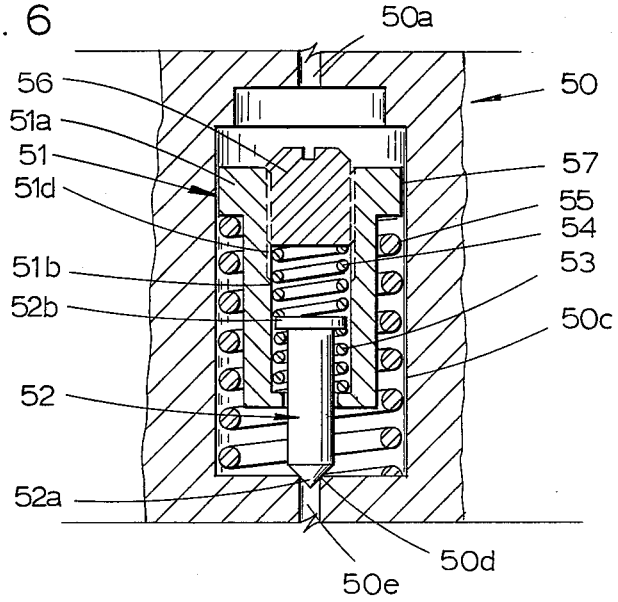
FIG. 6 is a partial sectional view optionally usable with the preferred embodiment of this invention to create higher frequency oscillations in pulse media.

The device of FIG. 6 is to superimpose a high frequency pressure variation upon a fluid pressure pulse in the fluid moving in the pipe string. The embodiment shown may be installed in channel 2*f* of FIG. 1A or it may be connected between any part of the openings exposed to the fluid pressure above orifice 2*e* and a lower pressure fluid body such as in annulus 1*r*.

When no fluid is flowing in port 50*a* and out port 50*e*, spring 55 moves piston 51*a* upwardly. At the upper limit of travel of piston 51*a* poppet 52 is lifted out of contact with orifice 50*d* by spring 53. Pressure differential between port 50*a* and port 50*e* will cause a downward flow of fluid in cavity 50*c* and piston 51*a* will push assembly 51 downwardly. Poppet 52 has upper flange 52*b* held in a neutral position between springs 53 and 54. When assembly 51 has moved to a position such that conic point 52*a* obstructs orifice 50*d*, downward movement of fluid and hence downward movement of assembly 51 will cease. Fluid will leak past annulus 57 between piston 51*a* and the surface of opening 50*c*, allowing assembly 51 to move upwardly as urged by spring 55. The pressure differential between port 50*a* and 50*e* will act to hold poppet 52 in contact with orifice 50*d* with a force equal to the product of the pressure differential and the area of orifice 50*d*. This will act through flange 52*b* to move the poppet below the neutral point normally determined by springs 53 and 54. When the imbalance between the two springs finally lifts the poppet from the orifice, the poppet will move upwardly relative to assembly 51 to its neutral point. This produces an oscillating action of a frequency adjustable by adjusting the travel of the poppet between its position when lifted off orifice 50*d* and it neutral position. Since it is known that some frequencies transmit better than others in a reasonably resilient system, means to adjust the higher frequency is provided. Adjustment plug 56 in bore 51*b* has external threads mating threads 51*d* in piston 51*a*. Movement of plug 56 relative to piston 51*a* changes the neutral position of poppet 51 relative to piston 51*a* and hence, changes the frequency of oscillations of assembly 51. This oscillation will cause an oscillating pressure in cylinder 2*t* and opening 3*j* and, therefore, cause valve element 3 to oscillate axially. The axial oscillation of element 3 will produce a synchronous oscillation of the fluid pressure making up the fluid pressure pulse being transmitted from the down hole location to the earth surface. The rate of increase in pressure within cylinder 2*t* and 3*j* can be regulated by the size of channel 3*d* and port 3*c*; therefore, the rate of increase of differential or signal pressure across orifice 1*b* can be regulated. A signal pressure is producible having the form of a saw tooth curve. Since the oscillation frequency of the device of FIG. 6 is dependent upon the pressure difference between channel 50*a* and channel 50*e*, the higher frequency produced by the device of FIG. 6 can then be caused to sweep a selected frequency band at each pulse. Ideally, such a frequency band will contain a resonant frequency of the pipe string and contained fluid resilient system.

The pressure drop across orifice 1*b* due to the upward movement of element 3 is proportional to the pressure drop across orifice 2*e* of FIG. 1. The downthrust on member 4 when member 4 is in the upper position is proportional to the pressure drop across orifice 2*e*. The upward force applied to member 4 is determined by the resilience of member 15 which transfers force from assembly 7 to member 4. The resilience of member 15, then, determines the maximum differential pressure across orifice 1*b* during pressure pulse transmission.

With reference to the device of FIG. 1A, it is to be pointed out that member 4 may be connected directly to valve element 3, eliminating the need for cylinder 2*t*, orifice 2*e* and piston 3*h*. Spring 10, then, would not be necessary. Spring 16 would limit the upward thrust of element 3 and, hence, limit the pressure differential produced across orifice 1*b*.

Figure 7:
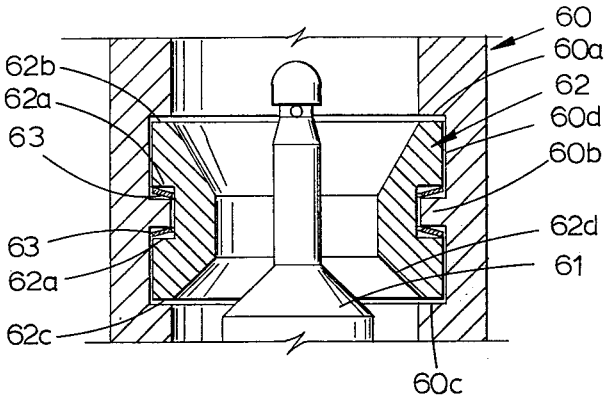
FIG. 7 is a vertical sectional view of an optional hammering device to use in higher frequency oscillations transmission through the material of the pipe string.

The device of FIG. 7 provides means to utilize the pressure drop across an orifice such as 1*b* of FIG. 1 to deliver a hammer effect to the pipe string to enhance the transmission of information through the pipe string material.

Housing 60 is similar to housing 1 of FIG. 1. Valve element 61 is similar to element 3 of FIG. 1. Movable element 62 is situated for limited axial movement within cavity 60*d*. Element 62 is positioned by conical springs 63 on each side of web 60*b* and act against shoulders 62*a*.

When element 61 is moved upward toward surface 62*d*, a pressure drop across element 61 is caused and urges element 62 downward. When element 62 moves downward far enough, end 62*c* strikes face 60*c*. If element 61 moves downward the reverse occurs and element 62 moves upward and end 62*b* strikes face 60*a*. If element 61 rapidly oscillates axially with a particular frequency and amplitude element 62 will hammer at opposite ends 62*b* and 62*c* against faces 60*a* and 60*c* at a particular frequency. This simultaneously produces a pressure pulse with a superimposed high frequency oscillation and a stress pulse in the pipe string wall with a higher frequency superimposed.

The effect of drilling string elongation due to pulse generation will influence torque if a drill bit is consuming rotational power against hole bottom. The influence of the pulse upon torque will be greater if resilient means such as a bumper sub or shock sub is placed above the pulse generator. If the resilient means is placed below the pulse generator the effect of a pressure pulse upon torque will be minor. Where simultaneous pulse transmission in two or more transmission media is desired, the make-up of the down hole assembly will be arranged to achieve the preferred allocation of pulse energy among the media as dictated by the particular operational circumstances.

Figure 8:
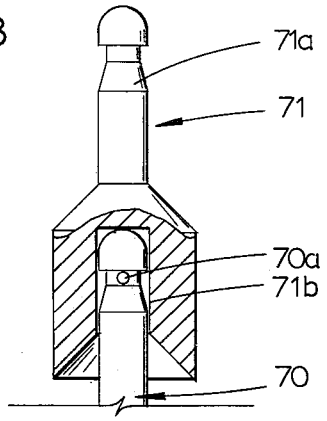
FIG. 8 is a vertical sectional view of a pulse generator disabling element to be dropped down the drill string bore.

The device of FIG. 8 represents means to disable the pulse generator when it is not needed. Member 70 is comparable to the probe of element 3 of FIG. 1. Member 71 is dropped down the bore of the pipe string and opening 71*b* slips over probe 70 closing off intake port 70*a* so that the pulse generator cannot receive fluid power to operate. Member 71 has probe 71*a* so that it may be recovered by an overshot lowered on a sand line.

Optionally, member 71 may be equipped with lifting pawls to engage the overshot groove of probe 70 so that when member 71 is recovered, all the package attached to probe 70 for lifting will be recovered in one trip.

Figure 9:
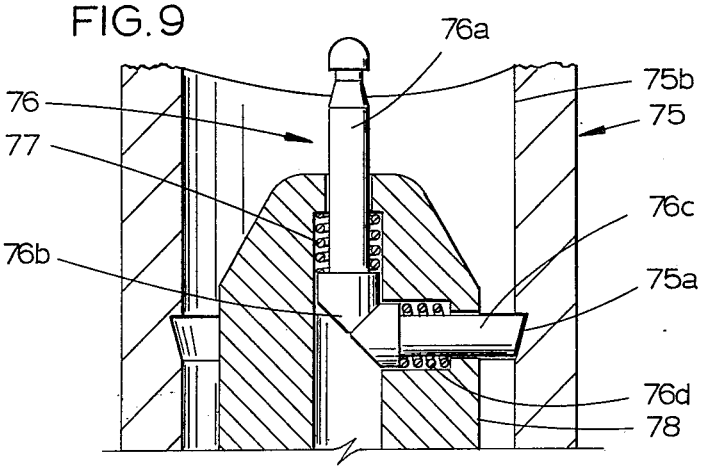
FIG. 9 is a vertical sectional view of a device to lock the device of this invention into a pipe string when fluid is flowing upward and the device is used upside down.

The device of FIG. 9 is to be used to hold the removable instrument package down in a pipe string when the package is used upside down and fluid flows upward. Instrument package 78 is positioned in pipe string 75 such that radially movable latch lugs 76*c* can move outward as urged by cam 76*b* to engage groove 75*a* on the outside of pipe bore 75*b*. Member 76 extends upward in the form of an overshot probe 76*a* and downward as cam 76*b*. Member 76 is urged downward by spring 77 which is much stronger than spring 76*d* which urges lug 76*c* radially inward. Instrument package 76 is retained in position against the upthrust of pulse generation in upwardly flowing fluid. To recover package 78 an overshot is lowered to grip probe 76*a*. By lifting probe 76*a*, cam 76*b* allows lug 76*c* to move inwardly as urged by spring 76*d* and the package is free to be lifted. Alternately, a member such as shown in FIG. 8 may be dropped down the bore of a pipe string with little or no upward movement of fluid in the pipe bore. The outside diameter of member 71 is then such that by allowing a high rate of upward flow of fluid, member 71 along with its cargo of package 78 is blown to the earth surface through the pipe string bore.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A device to create pressure pulses in fluid moving in a pipe string for use in earth bore hole related operations to transmit information to the earth surface from a down hole assembly attached to a pipe string comprising; first valve means supported in the pipe string through which at least part of the fluid flows to change the resistance to flow to produce periodic pressure pulses in said fluid by movement to and from a first position of generally more flow restriction and a second position of generally less flow restriction, moving means to move said first valve from said first position to said second position, actuator means having a second valve positionable in two positions to control the movement of the moving means, said actuator means also having means responsive to the fluid pressure differential across the first valve means to move the second valve means to one of said two positions at a repetition rate and thus control the movement of the moving means to cycle at said repetition rate to constantly cycle the first valve means between said first and second positions, sensor means to sense at least one downhole condition, regulator means responsive to the output of said sensor to control the cyclic repetition rate of said actuator means so that the pressure pulses periodically produced in the fluid will have a repetition rate that is proportional to the output of said sensor.

2. The device of claim 1 in which said actuator means includes means to bias the actuator to move said valve toward said first position and includes force means responsive to the pressure differential across said valve to urge the actuator to move said valve toward said second position with a force that is greater than said bias means when said valve is in said first position and less than said bias means when said valve is in said second position so that said actuator is not stable in either said first or said second position so that minimal control effort is required to cause said actuator and valve to operate as an astable oscillator to produce pulses in the fluid stream.

3. The device of claim 2 being further provided with means to delay the application of force by said force means to move said valve from said first position for a preselected amount of time so that within preselected pressure differential limits across said valve a preselected amount of signal energy can be developed in the fluid stream.

4. The device of claim 2 in which the force to bias said actuator toward closure is provided by a spring.

5. The device of claim 2 in which the force to bias said actuator toward closure is provided partly by a spring and partly by a fluid powered force means responsive to the pressure drop across said valve.

6. The device of claim 1 in which said regulator means is a dashpot, the rate of movement in at least one direction being regulated, the movement per cycle being limited by interference of a stop means responsive to said sensor such that the cyclic repetition rate of the movement of said dashpot between opposite movement limits is proportional to the position of said stop means and, therefore, proportional to the output of said sensor.

7. The devide of claim 1 including a sensor to sense the relative position between a preselected radial line in said down hole assembly and the low side of a non-vertical earth bore hole.

8. The device of claim 1 including a sensor to sense the azimuthal relative positions of a selected tool face of the down hole assembly and a magnetic field in the earth.

9. The device of claim 1 including a sensor to sense the position of a gyroscope radial line index relative to a tool face of the down hole assembly.

10. The device of claim 1 being further provided with means to cause an oscillating action of said valve when said valve is in said first position to cause a plurality of superimposed pressure variations in the differential pressure across said valve to extend the distance a distinguishable signal will travel.

11. The device of claim 10, further provided with a movable member supported in the pipe string for limited axial movement therein, means responsive to said pressure drop including said superimposed pressure variations across said flow resistance changing means to move said member axially to cause a series of stress variations in the pipe string wall during pressure pulse generation that can be detected in the pipe side wall axial stress variations at the earth surface.

12. The device of claim 1 in combination with resilient means in the drill string above said valve means by which the downthrust against said means to change the resistance to downward flow of fluid in the pipe string is used to increase the length of the drill string and thereby increase the load on a drilling bit attached to the pipe string to change the reaction torque of said bit so that as fluid pressure pulses are generated a torque pulse is simultaneously generated for transmission of said torque pulse to the earth surface through the drill string.

13. The device of claim 1 further comprising; a housing movable through the bore of the pipe string, means to stop the movement of said housing in a preselected position within the pipe bore, and wherein said first valve means comprises an area of the inner surface of said pipe string as one element, and a member supported by said housing for movement relative thereto as a second element, said member being supported by said housing such that when said housing is in said preselected position said member is relatively close to said area so that a preselected amount of mevement of said member will cause a preselected change in the flow area between said member and said surface, and wherein said moving means are positioned within said housing and operate to move said member to position said first valve means in said first and second positions.

14. A device for controlling the frequency of oscillations of a moving element, the cyclic frequency of which is used to indicate the output of a sensor in generating information pulses to be transmitted along a pipe string without placing stresses upon the sensor and without taking power from the sensor comprising; a stress bearing member movable in response to the sensor, which said oscillating element strikes at least once each cycle, the distance traveled between impacts between said element and said member being related to the position of said member and determining the frequency of oscillation, means to resiliently support said member in a position relative to said element determined by the output of the sensor such that said member, when struck by said moving element will move relative to the sensor without transferring significant loads to the sensor, to transfer impact loads to a non-sensitive machine element, said resilient support means, after impact, moving said stress bearing member away from said machine element so that said sensor can reposition said stress bearing member in response to sensed values without sliding friction.

15. A device to create pressure pulses in fluid moving in a pipe string for use in earth bore hole related operations to transmit information to the earth surface from a down hole assembly attached to a pipe string comprising; first valve means supported in the pipe string through which at least part of the fluid flows to change the resistance to flow by movement to and from a first position of generally more flow restriction and a second position of generally less flow restriction, moving means to move said first valve from said first position to said second position, unstable actuator means having a second valve positionable in two positions to control the movement of the moving means, said actuator means being powered by the pressure difference across the first valve means to move the second valve means to one of said two positions at a repetition rate and thus control the movement of the moving means to cycle at said repetition rate to constantly cycle the first valve means between said first and said second positions, sensor means to sense at least one down hole condition to be evaluated, regulator means responsive to the output of said sensor to control the cyclic repetition rate of said actuator means so that the pressure pulses periodically produced in the fluid will have a repetition rate that is proportional to the output of said sensor, means to induce an oscillatory action in said first valve means to create a plurality of superimposed pressure variations upon said pressure pulse.

16. A device to create stress variations in a pipe string wall for use in earth bore hole related operations to transmit information to the earth surface from a down hole assembly attached to a pipe string comprising; valve means supported in the pipe string through which at least part of the fluid flows to change the resistance to flow to produce periodic pressure changes in said fluid, actuator means coupled with said valve to cause said valve to cause said pressure changes, at least one sensor to sense at least one downhole condition to be evaluated, regulator means responsive to said sensor to control said actuator, a moveable member supported in the pipe string for limited axial movement between axial constraints situated within and attached to said pipe string, means responsive to said pressure changes to oscillate said member axially to cause a series of varying loads to be applied against said constraints to cause stress variations in the pipe string wall that can be detected at the earth surface whereby the sensor output is transmitted to the earth surface.

* * * * *